US009165523B2

(12) United States Patent
Funayama et al.

(10) Patent No.: US 9,165,523 B2
(45) Date of Patent: Oct. 20, 2015

(54) DRIVER CIRCUIT FOR IMAGE LINES OF A DISPLAY DEVICE WITH ARRANGEMENT TO IMPROVE MULTI-LEVEL GRAYSCALE DISPLAY

(75) Inventors: Yukihide Funayama, Mobara (JP); Yoshihiro Kotani, Chiba (JP); Shuuichirou Matsumoto, Mobara (JP)

(73) Assignee: Japan Display Inc., Tokyo (JP)

( * ) Notice: Subject to any disclaimer, the term of this patent is extended or adjusted under 35 U.S.C. 154(b) by 0 days.

(21) Appl. No.: 13/334,233

(22) Filed: Dec. 22, 2011

(65) Prior Publication Data

US 2012/0162287 A1 Jun. 28, 2012

(30) Foreign Application Priority Data

Dec. 28, 2010 (JP) ..... 2010-292959

(51) Int. Cl.
*G09G 3/36* (2006.01)

(52) U.S. Cl.
CPC ..... *G09G 3/3688* (2013.01); *G09G 3/3614* (2013.01); *G09G 3/3655* (2013.01); *G09G 3/3696* (2013.01); *G09G 2310/027* (2013.01); *G09G 2310/0291* (2013.01); *G09G 2310/0297* (2013.01); *G09G 2320/0219* (2013.01); *G09G 2320/0238* (2013.01); *G09G 2320/0276* (2013.01); *G09G 2330/028* (2013.01)

(58) Field of Classification Search
CPC ..... G09G 2310/027
See application file for complete search history.

(56) References Cited

U.S. PATENT DOCUMENTS

| | | | | |
|---|---|---|---|---|
| 6,166,714 | A * | 12/2000 | Kishimoto | 345/96 |
| 6,184,855 | B1 * | 2/2001 | Kobayashi et al. | 345/100 |
| 7,417,614 | B2 * | 8/2008 | Goto et al. | 345/96 |
| 2002/0126081 | A1 * | 9/2002 | Adachi et al. | 345/92 |
| 2004/0075780 | A1 * | 4/2004 | Lee | 349/43 |
| 2004/0196231 | A1 | 10/2004 | Goto et al. | |

(Continued)

FOREIGN PATENT DOCUMENTS

| | | |
|---|---|---|
| CN | 1619631 A | 5/2005 |
| CN | 101233556 | 7/2008 |

(Continued)

OTHER PUBLICATIONS

Office Action in Chinese Patent Application No. 201110456259.3, dated Jan. 13, 2014 (English language translation only; 3 pgs.).

(Continued)

*Primary Examiner* — Seokyun Moon
(74) *Attorney, Agent, or Firm* — Lowe Hauptman & Ham, LLP

(57) ABSTRACT

A driver circuit including a DA converting circuit that converts video data input from the outside to a grayscale voltage; an amplifying circuit that amplifies the grayscale voltage; and a switch circuit that selects the grayscale voltage output from the amplifying circuit and a predetermined voltage as a voltage that is output to the image line. When video data indicating a minimum grayscale, the switch circuit outputs the predetermined voltage to the image line, and when video data indicating a grayscale other than the minimum grayscale is input, the switch circuit outputs the grayscale voltage output from the amplifying circuit to the image line. The predetermined voltage allows a voltage of the pixel electrode and a voltage of the counter electrode after passage of the writing of the image voltage to be coincident with each other.

7 Claims, 10 Drawing Sheets

(56) References Cited

U.S. PATENT DOCUMENTS

| | | | | |
|---|---|---|---|---|
| 2007/0070011 | A1* | 3/2007 | Tang | 345/92 |
| 2008/0186267 | A1* | 8/2008 | Mamba et al. | 345/87 |
| 2008/0246718 | A1 | 10/2008 | Tanaka | |
| 2009/0079713 | A1* | 3/2009 | Nagashima | 345/204 |
| 2009/0109142 | A1* | 4/2009 | Takahara | 345/76 |
| 2009/0262057 | A1* | 10/2009 | Yoon et al. | 345/89 |
| 2010/0195004 | A1 | 8/2010 | Hotelling | |
| 2011/0115779 | A1* | 5/2011 | Fujikawa | 345/212 |

FOREIGN PATENT DOCUMENTS

| | | | |
|---|---|---|---|
| CN | 101551546 | A | 10/2009 |
| CN | 101847376 | A | 9/2010 |
| JP | 11-338430 | | 12/1999 |
| JP | 2001-282205 | | 10/2001 |
| JP | 2004-274335 | | 9/2004 |
| JP | 2006-106657 | | 4/2006 |
| JP | 2008-256811 | | 10/2008 |
| TW | 200417962 | A | 9/2004 |

OTHER PUBLICATIONS

Office Action in Chinese Patent Application No. 201110456259.3, dated Jul. 25, 2014 (English language translation only; 3 pgs.).

Office Action of Chinese Patent Application No. 201110456259.3 dated Jan. 9, 2015 corresponding to the present application.

* cited by examiner

DRIVER CIRCUIT FOR IMAGE LINES OF A DISPLAY DEVICE WITH ARRANGEMENT TO IMPROVE MULTI-LEVEL GRAYSCALE DISPLAY

CROSS-REFERENCE TO RELATED APPLICATION

The present application claims priority from Japanese application JP2010-292959 filed on Dec. 28, 2010, the content of which is hereby incorporated by reference into this application.

BACKGROUND OF THE INVENTION

1. Field of the Invention

The present invention relates to a driver circuit, and more particularly, to a driver circuit that outputs a signal to an image line of a display device (for example, a liquid crystal display device or the like) that is capable of performing multi-level grayscale displaying.

2. Description of the Related Art

As a high-definition color monitor of a computer or other information apparatuses, or a display device of a television receiver, a liquid crystal display device is used.

The liquid crystal display device includes a so-called liquid crystal display panel. In this liquid crystal display panel, basically, a liquid crystal layer is interposed between two (a pair of) substrates, at least one of the substrates being formed of transparent glass or the like. When a voltage is selectively applied to various electrodes formed on the substrate of the liquid crystal display panel in correspondence with sub-pixels, the sub-pixels are turned on or turned off. The liquid crystal display panel is excellent in contrast performance and high-speed display performance.

Generally, the liquid crystal display panel includes an image line, and a grayscale voltage is input to a pixel electrode of each sub-pixel in the liquid crystal display panel from a drain driver through the image line. The drain driver includes multi-level voltage generating circuit, a grayscale voltage selecting circuit that selects one grayscale voltage corresponding to display data from among multi-level voltages generated by the multi-level voltage generating circuit, and an amplifier circuit to which the one grayscale voltage selected by the grayscale voltage selecting circuit is input.

The above-described drain driver is disclosed in JP2008-256811A.

SUMMARY OF THE INVENTION

In a normally black type liquid crystal display panel, it is necessary to set a voltage, which is input to a pixel electrode of each sub-pixel in the liquid crystal display panel, to a GND potential (0 V) so as to reduce black brightness. However, in the amplifier circuit of the drain driver, it is difficult to output a complete GND potential (0 V), and as a result thereof, there is a problem in that the brightness increases at the time of a black displaying and thereby the contrast decreases. This is for the following reasons. Generally, the amplifier circuit of the drain driver includes a differential stage, and an output stage. However, commonly, at the output stage, a desired image voltage (grayscale voltage) is supplied by a MOS transistor provided between a power supply voltage of VDD, and a power supply voltage of GND. Here, in a case where the GND potential (0 V) is output from the output stage, the MOS transistor connects an output terminal of the output stage and a power supply line through which the power supply voltage of GND is supplied, but as the output voltage approaches a GND level, a voltage difference between the drain and the source of the MOS transistor becomes small. When the output voltage of the output stage becomes small to a threshold voltage of the MOS transistor, a current does not flow between the output terminal of the output stage and a power supply line through which the power supply voltage of GND is supplied. Due to this phenomenon, the output voltage rises up at the time of performing the black display in the liquid crystal display panel, thereby causing a reduction in the contrast.

The invention has been made to solve the above-described problems, and an object of the invention is to provide a technology that is capable of improving the contrast in a driver circuit used in a display device compared to the related art.

The above-described object and other objects, and new characteristics of the invention will be apparent from the following detailed description and the accompanying drawings.

When being briefly described, representative outlines of aspects of the invention disclosed in the present application are as follows.

(1) a driver circuit including an image line driving circuit that supplies a grayscale voltage to a pixel electrode included in a pixel having the pixel electrode and a counter electrode through an image line according to video data input from outside. When the grayscale voltage of a minimum-level grayscale that is a grayscale which allows a potential difference between the counter electrode and the pixel electrode to be smallest is supplied during an image voltage writing period, the voltage of the pixel electrode is identical to a voltage of the counter electrode. For example, the identical voltage may be a GND voltage.

(2) A driver circuit that supplies a grayscale voltage to a pixel electrode included in a pixel having the pixel electrode and a counter electrode through an image line according to video data input from outside. The driver circuit includes a DA converting circuit that converts the video data input from the outside to a grayscale voltage corresponding to the video data; an amplifying circuit that amplifies the grayscale voltage output from the DA converting circuit; and a switch circuit that selects the grayscale voltage output from the amplifying circuit and a predetermined voltage as a voltage that is output to the image line. When video data indicating a minimum-level grayscale that is a grayscale which allows a potential difference between the counter electrode and the pixel electrode to be smallest is input, the switch circuit outputs the predetermined voltage to the image line, and when video data indicating a grayscale other than the minimum-level grayscale is input, the switch circuit outputs the grayscale voltage output from the amplifying circuit to the image line. The predetermined voltage is a voltage (for example, a GND voltage) that allows a voltage of the pixel electrode and a voltage of the counter electrode after passage of an image voltage writing period to be identical to each other.

(3) The driver circuit described in the item (2) further includes a register in which data for controlling the switch circuit is stored, in which a first state and a second state are selected according to the data stored in the register. In the first state, when video data indicating the grayscale other than the minimum-level grayscale is input, the switch circuit outputs the grayscale voltage output from the amplifying circuit to the image line, and when video data indicating the minimum-level grayscale is input, the switch circuit outputs the predetermined voltage to the image line. In the second state, the switch circuit outputs the grayscale voltage output from the amplifying circuit to the image line regardless of the grayscale.

(4) A driver circuit that supplies a grayscale voltage to a pixel electrode included in a pixel having the pixel electrode and a counter electrode through an image line according to video data input from outside. The driver circuit includes a DA converting circuit that converts the video data input from the outside to a grayscale voltage corresponding to the video data; an amplifying circuit that amplifies the grayscale voltage output from the DA converting circuit; and a grayscale voltage generating circuit that supplies plural grayscale voltages to the DA converting circuit. The grayscale voltage is generated by the grayscale voltage generating circuit and the grayscale voltage of the minimum-level grayscale is a GND voltage.

(5) In the driver circuit described in the item (4), the grayscale voltage generating circuit divides plural grayscale reference voltages input from outside and generates a grayscale voltage of each level, and one of the plural grayscale reference voltages may be a voltage that is the same as the grayscale voltage of the minimum-level grayscale.

The following is a briefly-described effect obtained by a representative invention disclosed in the present application.

According to a display device using the driver circuit of the invention, it is possible to improve contrast as compared with a display device in the related art.

DETAILED DESCRIPTION OF THE INVENTION

Figure 1:
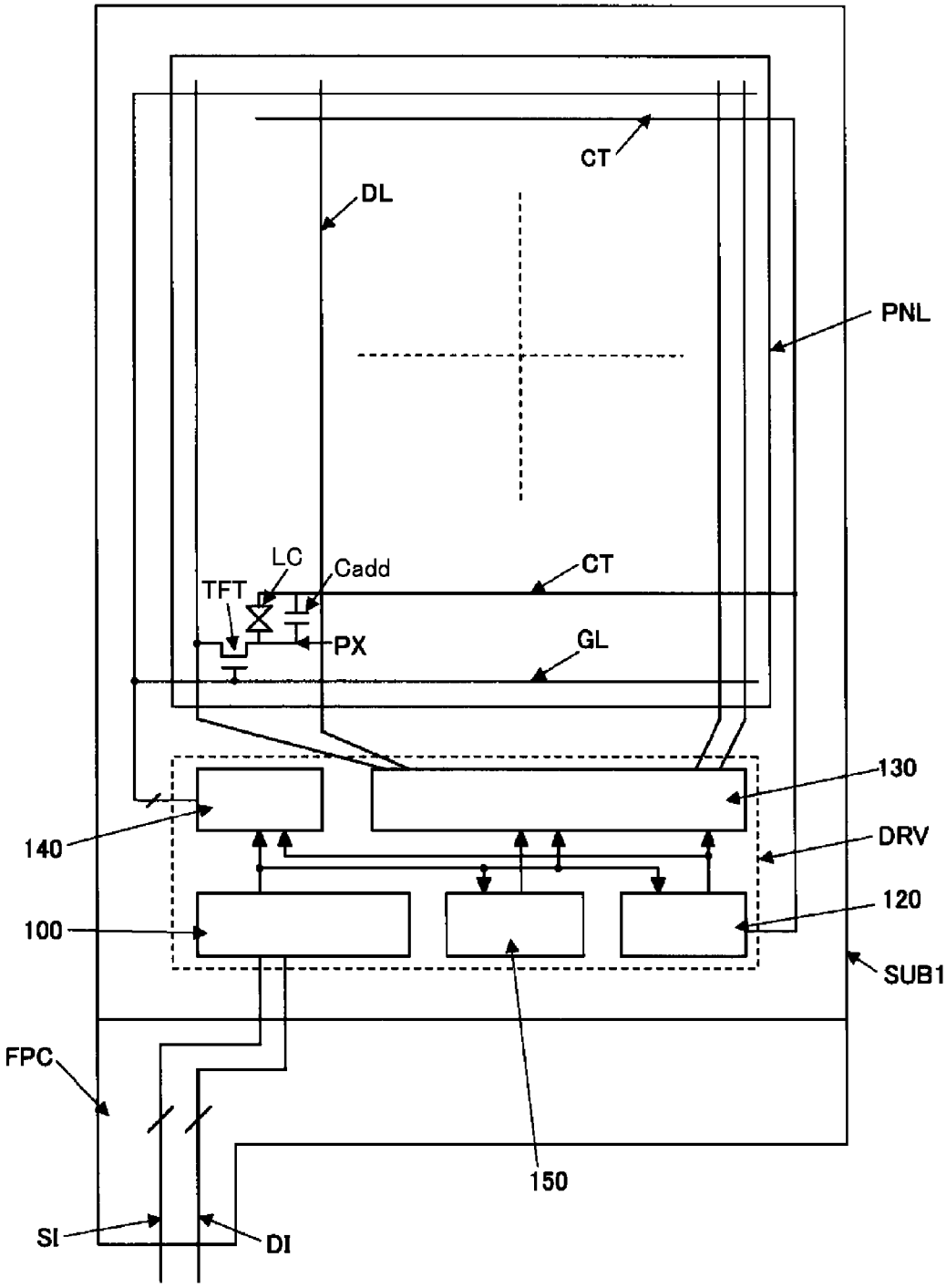
FIG. 1 is a block diagram illustrating a schematic configuration of a liquid crystal display device using a drain driver according to an embodiment of the invention.

Hereinafter, the invention will be described in detail with reference the accompanying drawings.

In addition, in all the drawings for describing embodiments, the same reference characters will be given to components having substantially the same functions, and description thereof will not be repeated. The following embodiments are not intended to restrict analysis of the scope of claims of the invention.

[First Embodiment]

FIG. 1 shows a block diagram illustrating a schematic configuration of a liquid crystal display device using a drain driver according to an embodiment of the invention. The liquid crystal display device shown in FIG. 1 includes a liquid crystal display panel PNL, a driver circuit DRV, and a flexible printed circuit board FPC.

In the liquid crystal display panel PNL, plural scanning lines (gate lines) GL, and plural image lines (source lines or drain lines) DL are provided in parallel with each other, respectively. A sub-pixel is provided in correspondence with a portion where each of the scanning lines GL and each of the image lines DL are intersected.

Plural sub-pixels is disposed in a matrix shape, and a pixel electrode PX and a thin film transistor TFT are provided to each of the sub-pixels. A counter electrode CT (referred to as a common electrode) is provided so as to be opposite to each of the pixel electrodes PX. A liquid crystal capacitor LC and a retentive capacitor Cadd are formed between each of the pixel electrodes PX and each of the counter electrodes CT.

The liquid crystal display panel PNL includes a first glass substrate SUB1 on which the pixel electrodes PX, the thin film transistor TFT, or the like are formed, a second glass substrate (not shown) on which a color filter and the like are formed, a sealing material, liquid crystal, and a polarization plate. The first glass substrate SUB1 and the second glass substrate are superimposed with a predetermined gap therebetween. The sealing material shaped like a frame is provided between both glass substrates in the vicinity of a peripheral portion of both the glass substrates, and bonds both the glass substrates. The sealing material seals liquid crystal that is filled into the inner side of the sealing material between both the substrates. The liquid crystal is injected from a liquid crystal filling port provided to a part of the sealing material. The polarization plate may be bonded to the outside of both the glass substrates.

In addition, the detailed description of an internal structure of the liquid crystal display panel will be omitted. Furthermore, the structure of the liquid crystal display panel PNL may be various. For example, in the case of a liquid crystal display panel of a vertical electric field type, the counter electrodes CT may be formed on the second glass substrate. In the case of a liquid crystal display panel of a horizontal electric field type, the counter electrodes CT may be formed on the first glass substrate SUB1.

In the liquid crystal display device shown in FIG. 1, a driver circuit DRV is mounted on the first glass substrate SUB1.

The driver circuit DRV includes a controller circuit 100, a drain driver 130 that drives the image lines DL of the liquid crystal display panel PNL, a gate driver 140 that drives the scanning lines GL of the liquid crystal display panel PNL, a power supply circuit 120 that generates a power supply voltage necessary for displaying an image on the liquid crystal display panel PNL, or the like, and a memory circuit 150.

Display data and a display control signal are input to the controller circuit 100 from a microcomputer (Micro Controller Unit; hereinafter, referred to as an MCU) at the side of a main unit, a graphic controller, or the like.

A system interface SI is a system to which various control signals and image data are input from the MCU or the like.

A display data interface (RGB interface) DI is a system to which external data such as image data formed by an external graphic controller, and a data fetch clock are continuously input.

In the display data interface DI, image data is sequentially fetched in correspondence with the data fetch clock similarly to a drain driver used in a personal computer of the related art.

The controller circuit 100 transmits display data received from the system interface SI and the display data interface DI to the drain driver 130 and the memory circuit 150 and controls a display.

The liquid crystal display device according to the embodiment adopts a dot inversion driving method that is one type of alternating current driving method.

Figure 2:
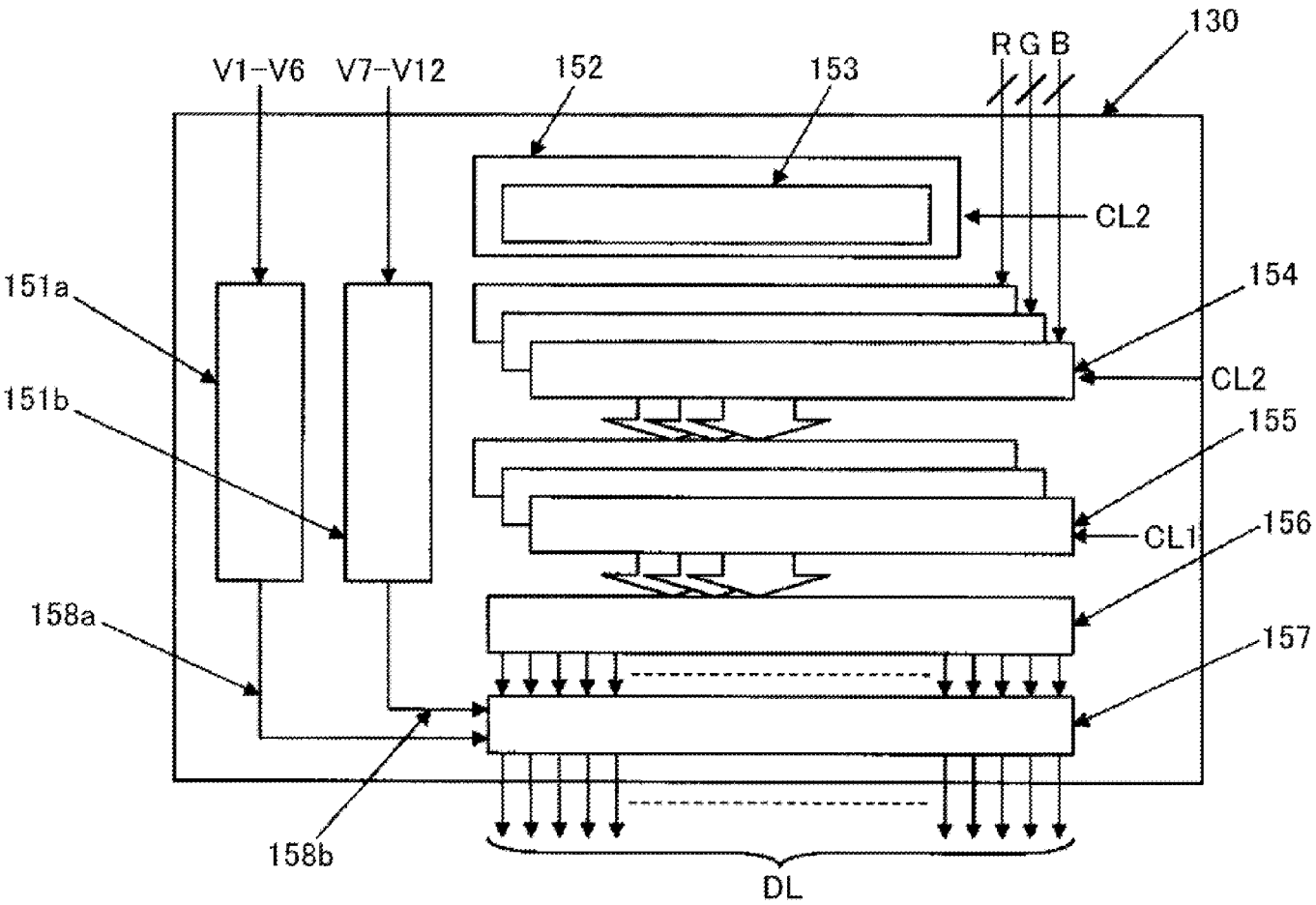
FIG. 2 is a block diagram illustrating a schematic configuration of the drain driver according to the embodiment of the invention.

FIG. 2 shows a block diagram illustrating a schematic configuration of the drain driver 130 according to the embodiment of the invention. The drain driver 130 includes a positive-polarity grayscale voltage generating circuit 151*a*, a negative-polarity grayscale voltage generating circuit 151*b*, a control circuit 152, an input register circuit 154, a storage register circuit 155, a level shift circuit 156, an output circuit 157, and voltage bus lines 158*a* and 158*b*.

The positive-polarity grayscale voltage generating circuit 151*a* generates a grayscale voltage of 256 levels at positive-polarity based on six positive-polarity grayscale reference voltages V1 to V6 that are input from the power supply circuit 120, and outputs this grayscale voltage to the output circuit 157 through the voltage bus line 158*a*. The negative-polarity grayscale voltage generating circuit 151*b* generates a grayscale voltage of 256 levels at negative-polarity based on six negative-polarity grayscale reference voltages V7 to V12 that are input from the power supply circuit 120, and outputs this grayscale voltage to the output circuit 157 through the voltage bus line 158*b*.

A shift register circuit 153 in the control circuit 152 of the drain driver 130 generates a data fetch signal for the input register circuit 154 based on a clock CL2 input from the controller circuit 100, and outputs it to the input register circuit 154.

The input register circuit 154 latches display data of eight bits (256 levels) for each color corresponding to output columns based on the data fetch signal output from the shift register circuit 153 in synchronization with the clock CL2 input from the controller circuit 100.

The storage register circuit 155 latches display data in the input register circuit 154 according to a clock CL1 input from the controller circuit 100.

The display data fetched to the storage register circuit 155 is input to the output circuit 157 through the level shift circuit 156. The output circuit 157 selects one grayscale voltage (a voltage at one level of 256 levels) corresponding to the display data based on the grayscale voltage of 256 levels at the positive-polarity or the grayscale voltage of 256 levels at the negative-polarity, and outputs the selected grayscale voltage to each image line DL.

Figure 3:
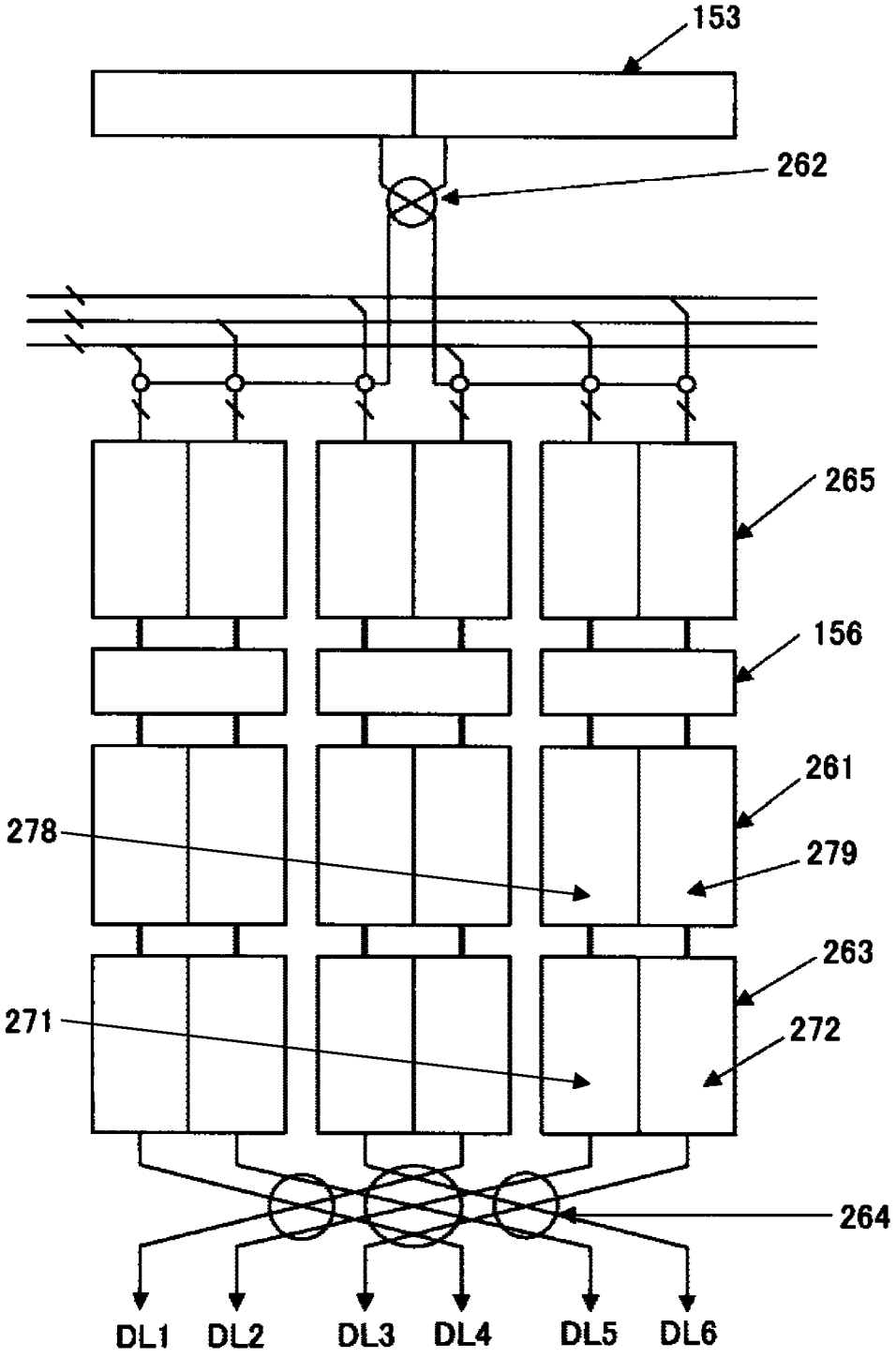
FIG. 3 is a block diagram illustrating a configuration of the drain driver shown in FIG. 2, in which a configuration of an output circuit is mainly described.

FIG. 3 is a block diagram illustrating a configuration of the drain driver 130 shown in FIG. 2, in which a configuration of the output circuit 157 is mainly described.

In FIG. 3, a first switch unit 262 switches the data fetch signal input to a data latch unit 265 from the shift register circuit 153. The data latch unit 265 corresponds to the input register circuit 154 and the storage register circuit 155 that are shown in FIG. 2. In addition, a decoder unit (grayscale voltage selecting circuit) 261, a pair of amplifier circuits 263, and a second switch unit 264 that switches an output of the pair of amplifier circuits 263 make up the output circuit 157 shown in FIG. 1. Here, the first switch unit 262 and the second switch unit 264 are controlled on the basis of an alternating signal M.

In addition, DL1 to DL6 represent first to sixth image line DL, respectively.

In the drain driver 130 shown in FIG. 3, the first switch unit 262 switches a data fetch signal that is input to the data latch unit 265 (more specifically, the input register circuit 154 shown in FIG. 2), and inputs display data for each color to the adjacent data latch unit 265 for each color.

The decoder unit 261 includes a high-voltage decoder circuit 278 and a low-voltage decoder circuit 279. The high-voltage decoder 278 selects a grayscale voltage at the positive-polarity corresponding to the display data output from each data latch unit 265 (more specifically, the storage register circuit 155 shown in FIG. 2) among grayscale voltages of 256 levels at the positive-polarity that are output from the grayscale voltage generating circuit 151*a* through the voltage bus line 158*a*. The low-voltage decoder circuit 279 selects a grayscale voltage at the negative-polarity corresponding to the display data output from each data latch unit 265 among grayscale voltages of 256 levels at the negative-polarity that are output from the negative-polarity grayscale voltage generating circuit 151*b* through the voltage bus line 158*b*. The high-voltage decoder circuit 278 and the low-voltage decoder circuit 279 are provided for each adjacent data latch unit 265.

The pair of amplifiers 263 includes a high-voltage amplifier circuit 271 and a low-voltage amplifier circuit 272. The positive-polarity grayscale voltage generated by the high-voltage decoder circuit 278 is input to the high-voltage amplifier circuit 271, and this high-voltage amplifier circuit 271 outputs the grayscale voltage at the positive-polarity. The grayscale voltage at the negative-polarity generated by the low-voltage decoder circuit 279 is input to the low-voltage amplifier circuit 272, and this low-voltage amplifier circuit 272 outputs the grayscale voltage at the negative-polarity.

In the dot inversion driving method, the polarity of a grayscale voltage of each adjacent color is reversed in each color, and an alignment of the high-voltage amplifier circuit 271 and the low-voltage amplifier circuit 272 of the pair of amplifier circuits 263 is the following order, that is, the high-voltage amplifier circuit 271→the low-voltage amplifier circuit 272→the high-voltage amplifier circuit 271→the low-voltage amplifier circuit 272, such that the first switch unit 262 switches the data fetch signal input to the data latch unit 265, and inputs the display data for each color to the adjacent data latch unit 265 for each color. In accordance with this, the second switch unit 264 switches an output voltage that is output from the high-voltage amplifier circuit 271 or the low-voltage amplifier circuit 272, and this output voltage is output to the image line DL to which the grayscale voltage for each color is input, for example, the first image line DL1 and the fourth image line DL4. In this way, it is possible to output the grayscale voltage at the positive-polarity or the negative-polarity to each image line DL.

Figure 4:
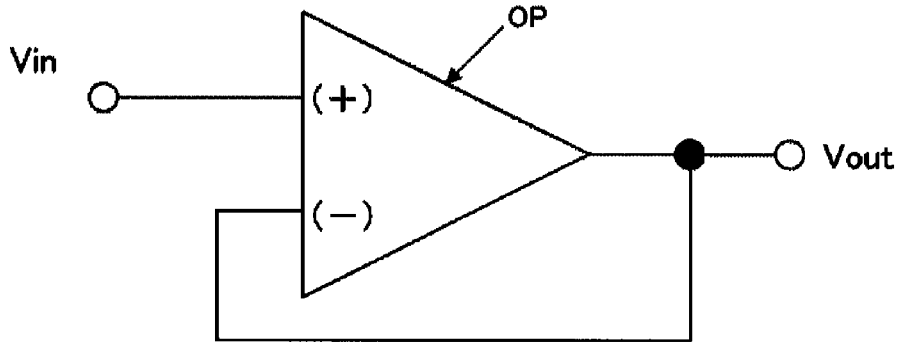
FIG. 4 is a diagram illustrating voltage follower circuit using an operational amplifier.
Figure 5:
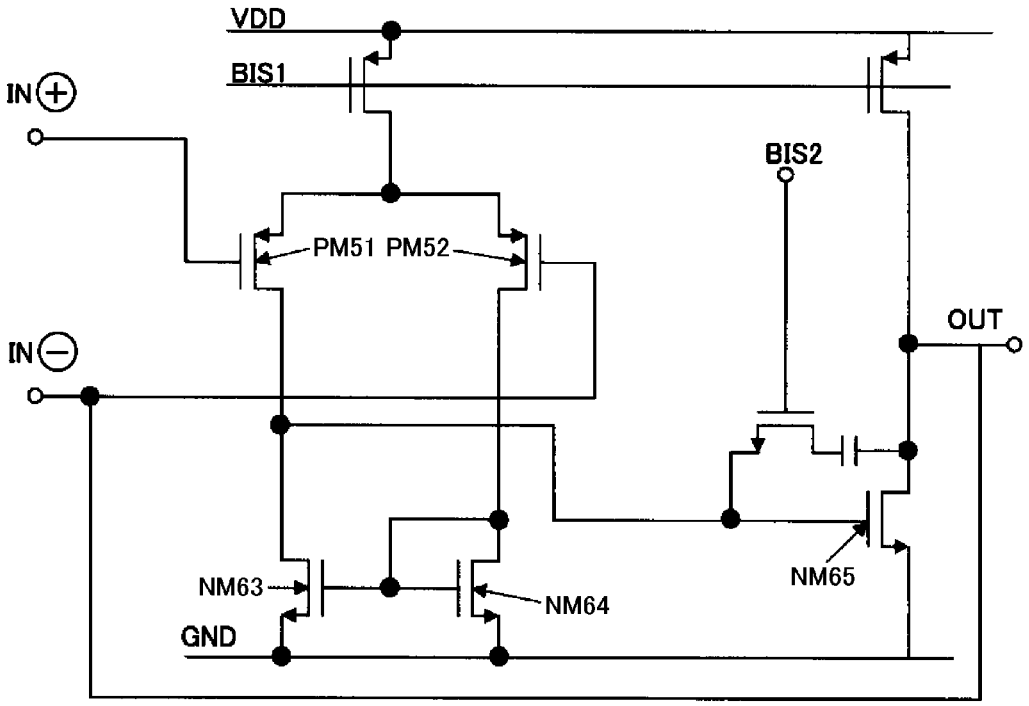
FIG. 5 is a circuit diagram illustrating an exemplary circuit configuration of a low-voltage amplifier circuit in the drain driver according to the embodiment of the invention.

The high-voltage amplifier circuit 271 and the low-voltage amplifier circuit 272 are configured by, for example, a voltage follower circuit as shown in FIG. 4. In the voltage follower circuit, an inverting input terminal (−) and an output terminal of an operational amplifier OP are directly connected, and a non-inverting input terminal (+) thereof serves as an input terminal. In addition, the operational amplifier OP used in the voltage follower circuit is configured by a differential amplifier circuit. In FIG. 5, an example of the low-voltage amplifier circuit 272 is shown. The low-voltage amplifier circuit 272 shown in FIG. 5 includes a PMOS transistor PM 51 of an input stage, NMOS transistor NM63 and NM64 that make up an active load circuit, and an NMOS transistor NM65 of an output stage.

In the example shown in FIG. 5, the amplifier circuit (the high-voltage amplifier circuit 271 or the low-voltage amplifier circuit 272) of the drain driver 130 includes the MOS transistor PM51, a differential stage including the NMOS transistors NM63 and NM64 that make up the active load circuit, and an output stage including the NMOS transistor NM65. In addition, when it is intended to output a GND potential (0 V) from an output terminal OUT of the output stage, it is necessary for the NMOS transistor NM65 to connect the output terminal OUT of the output stage and a power supply line through which power supply voltage of GND is supplied. However, as an output voltage approaches the GND level, the voltage difference between the drain and the source of the NMOS transistor NM65 becomes small. In addition, when the output voltage of the output stage becomes small to a threshold voltage of the NMOS transistor NM65, a current does not flow between the output terminal of the output stage and the power supply line through which the power supply voltage of GND is supplied, such that the NMOS transistor NM65 cannot supply a GND potential. As a result, the output voltage rises up at the time of performing the black displaying in the liquid crystal display panel PNL, thereby causing a reduction in the contrast (contrast=white brightness/black brightness).

To improve the contrast, it is necessary to make a voltage input to the pixel electrode PX and a voltage input to the counter electrode CT same so as to make a potential difference between both ends of liquid crystal be "0 V" at the time of performing the black displaying in the liquid crystal display panel PNL.

Figure 6:
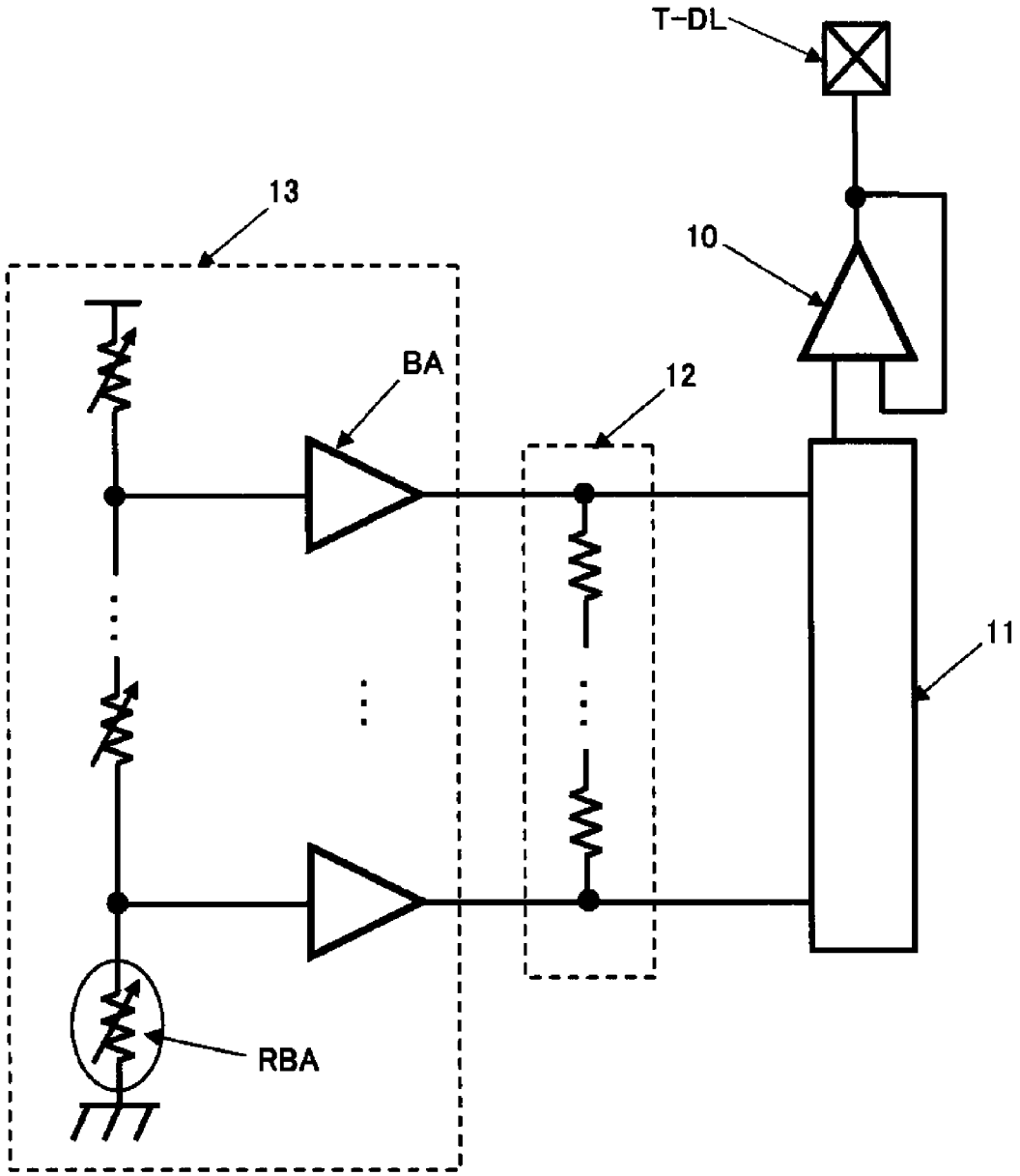
FIG.6 PRIOR ART
FIG. 6 is a diagram illustrating a circuit configuration of a grayscale voltage generating unit in the drain driver of a liquid crystal display device in the related art.

FIG. 6 shows a diagram illustrating a circuit configuration of a grayscale voltage generating unit in the drain driver of a liquid crystal display device in the related art. The drain driver 130 includes a terminal portion T-DL, an amplifier circuit 10, and a decoder circuit 11. The terminal portion T-DL is connected to the image line DL. The amplifier circuit 10 corresponds to the high-voltage amplifier circuit 271 or the low-voltage amplifier circuit 272 shown in FIG. 3. The decoder circuit 11 corresponds to the high-voltage decoder circuit 278 or the low-voltage decoder circuit 279 in FIG. 3. In addition, the number of the terminal portion T-DL, the number of the amplifier circuit 10, and the number of the decoder circuit 11 are equal to the number of the image lines DL respectively, but only one is shown in FIG. 6, and FIG. 8, FIG. 10A, FIG. 10B, and FIG. 11 described later.

A grayscale voltage generating circuit 12 corresponds to the positive-polarity grayscale voltage generating circuit 151*a* or the negative-polarity grayscale voltage generating circuit 151*b* shown in FIG. 2, and the grayscale voltage generating circuit 12 generates a grayscale voltage of 256 levels (a positive-polarity grayscale voltage of 256 levels or a negative-polarity grayscale voltage of 256 levels) based on grayscale reference voltages (six positive-polarity grayscale reference voltages V1 to V6 or six negative-polarity grayscale reference voltages V7 to V12) that are input from the power supply circuit 120. A grayscale reference voltage generating circuit 13 in the power supply circuit 120 includes a resistance division circuit. In addition, the grayscale reference voltage generating circuit 13 also includes a buffer circuit BA.

The decoder circuit 11 selects a grayscale voltage corresponding to display data among grayscale voltages input from the grayscale voltage generating circuit 12.

The amplifier circuit 10 amplifies the grayscale voltage input from the decoder circuit 11 and outputs this amplified grayscale voltage to the terminal portion T-DL.

In the circuit configuration shown in FIG. 6, the grayscale reference voltage, which becomes a grayscale voltage of the minimum-level grayscale (0 level), becomes a voltage of substantially 0.2 V due to a resistor element RBA shown in FIG. 6. Therefore, it is impossible to make a potential difference between both ends of the liquid crystal be "0 V".

Figure 7:
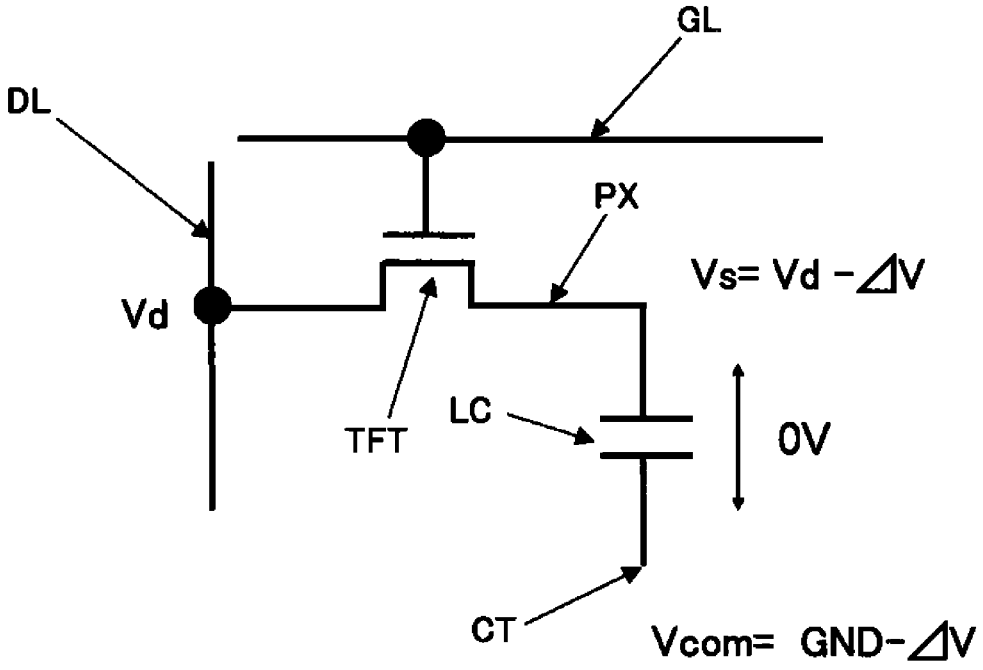
FIG. 7 is a diagram illustrating a circuit configuration of one sub-pixel shown in FIG. 1.

FIG. 7 shows a diagram illustrating a circuit configuration of one sub-pixel shown in FIG. 1.

During an image voltage writing period, a selecting scan voltage of a High level (hereinafter, referred to as "H level") is supplied to the scanning line GL. During the image voltage writing period, an image voltage Vd is written to the pixel electrodes PX from the image lines DL through a thin film transistor TFT.

Next, in a hold period after passage of the image voltage writing period, a non-selecting scan voltage of a Low level (hereinafter, referred to as "L level") is supplied to the scanning line GL. When it reaches the hold period, the potential of the pixel electrode PX is changed from a potential of Vd to a potential (Vd−ΔV).

This is because when a gate voltage of the thin film transistor TFT is changed from the H level to the L level, the potential of the pixel electrode PX decreases due to a coupling effect caused by a parasitic capacitance between the pixel electrode PX and the scanning line GL. (Generally, this is called "jumping-in").

The liquid crystal display device according to this embodiment adopts a dot inversion driving method as an alternating current driving method, but in the dot inversion driving method, a counter voltage Vcom input to the counter electrode CT is set to a voltage of a predetermined potential. In addition, in regard to the dot inversion driving method, in the case of the same grayscale, when a grayscale voltage at the positive-polarity and a grayscale voltage at the negative-polarity that are input to the pixel electrode PX are input in order that a potential difference between the counter electrode CT and the pixel electrode PX may be the same.

However, the potential of the pixel electrode PX is shifted toward a lower side due to the jumping-in, even in the case of the writing of the image voltage at the positive-polarity and in the case of the writing of the image voltage at the negative-polarity, such that in accordance with this, it needs to change a common voltage Vcom of the counter electrode CT to a voltage of Vcom-ΔV. That is, when a potential of Vcom is set to a GND potential, it is necessary to input a voltage of GND−ΔV to the counter electrode CT.

It is necessary to input the voltage of GND−ΔV to the pixel electrode PX in order to make a potential difference of both ends of liquid crystal layer be "0 V" so as to decrease the black brightness displayed on the liquid crystal display panel PNL in a state where a voltage of GND−ΔV is input to the counter electrode CT. That is, when a voltage output from the amplifier circuit of the drain driver 130 (the high-voltage amplifier circuit 271 or the low-voltage amplifier circuit 272) is "0 V", the black brightness becomes lowest.

Figure 8:
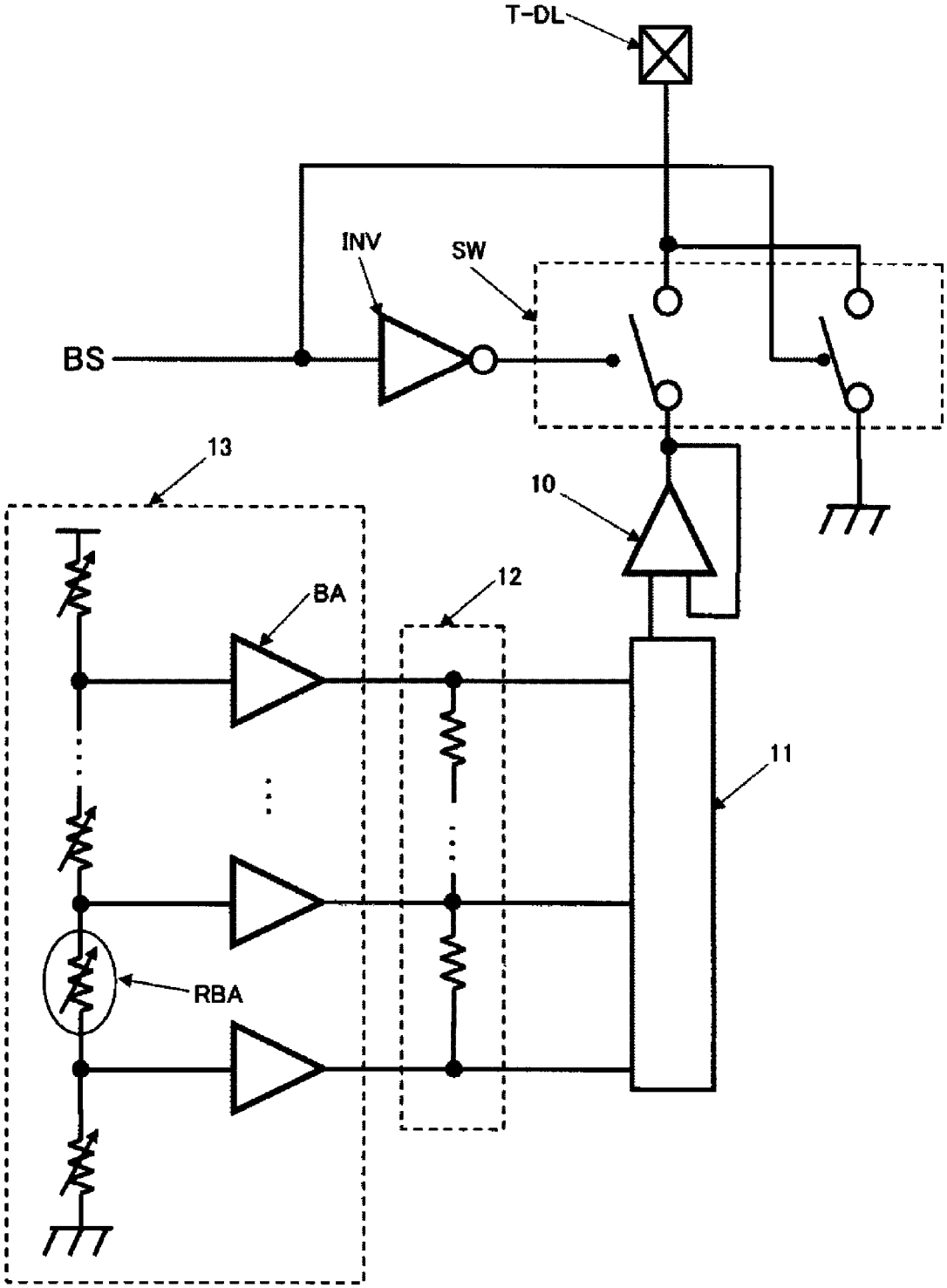
FIG. 8 is a diagram illustrating a circuit configuration of a grayscale voltage generating unit of the drain driver according to a first embodiment.

FIG. 8 shows a diagram illustrating a circuit configuration of the grayscale voltage generating unit of the drain driver according to the first embodiment. The drain driver 130 shown in FIG. 8 includes a terminal portion T-DL, an amplifier circuit 10, a decoder circuit 11, a buffer circuit BA, a switch circuit SW, and an inverter circuit INV. The terminal portion T-DL is connected to the image line DL. The amplifier circuit 10 corresponds to the high-voltage amplifier circuit 271 or the low-voltage amplifier circuit 272 in FIG. 3. The decoder circuit 11 corresponds to the high-voltage decoder circuit 278 or the low-voltage decoder circuit 279 in FIG. 3.

In the first embodiment, the switch circuit SW is provided between the amplifier circuit 10 and the terminal portion T-DL, and when a grayscale voltage of the minimum-level grayscale (0 level) is output from the terminal portion T-DL, the switch circuit SW is made to be switched to output a GND voltage.

Here, in FIG. 8, the switch circuit SW is controlled by a signal (BS) that becomes the H level at the time of the minimum-level grayscale (0 level), and becomes the L level at the time of other grayscales (1 to 255 levels). That is, when the signal BS is the L level, the switch circuit SW outputs an output of the amplifier circuit 10 to the terminal portion T-DL, and when the signal BS is the H level, the switch circuit SW outputs the voltage of the GND to the terminal portion T-DL.

Figure 9:
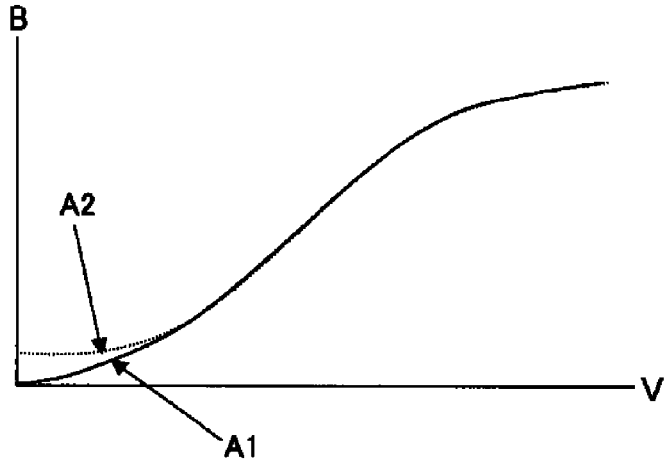
FIG. 9 is a graph illustrating brightness at the time of black displaying in the liquid crystal display device using the drain driver according to the first embodiment and brightness at the time of black displaying in a liquid crystal display device using a drain driver in the related art by comparing these cases with each other.

FIG. 9 shows a graph illustrating brightness at the time of black displaying in the liquid crystal display device using the drain driver according to the first embodiment and brightness at the time of black displaying in a liquid crystal display device using the drain driver in the related art by comparing these cases with each other.

In addition, in the graph shown in FIG. 9, the horizontal axis represents a grayscale voltage, and the vertical axis represents brightness. In addition, line A1 in FIG. 9 represents a grayscale voltage-brightness characteristic in the liquid crystal display device according to this embodiment, and line A2 in FIG. 9 represents a grayscale voltage-brightness characteristic in the liquid crystal display device in the related art.

As is clear from the graph in FIG. 9, when an image is displayed on the liquid crystal display panel PNL, in the case of this embodiment, brightness near the minimum-level grayscale (0 level) is lower than that of the liquid crystal display device in the related art.

Therefore, in the liquid crystal display device according to this embodiment, it is possible to improve contrast (contrast=white brightness/black brightness) as compared with the liquid crystal display device in the related art.

In addition, in this embodiment, it is necessary to appropriately adjust a resistance value of a resistor element of the grayscale reference voltage generating circuit 13, particularly, the resistor element RBA in FIG. 8 so as to correspond to the grayscale voltage-brightness characteristic represented by line A1 in FIG. 9.

[Second Embodiment]

Hereinafter, description will be made with respect to a liquid crystal display device according to a second embodiment of the invention, in which difference with the first embodiment will be mainly described.

Figure 10A:
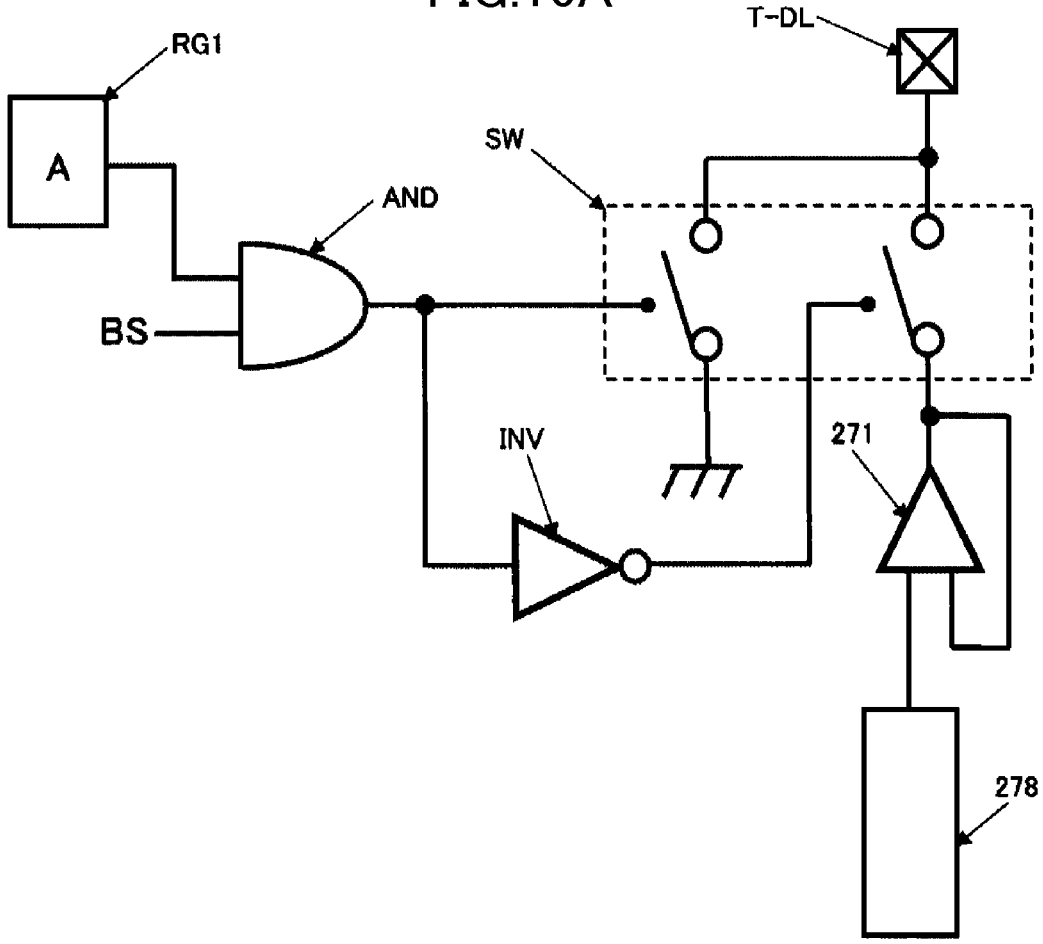
FIG. 10A is a diagram illustrating a circuit configuration of a positive-polarity grayscale voltage generating unit in a drain driver according to a second embodiment.
Figure 10B:
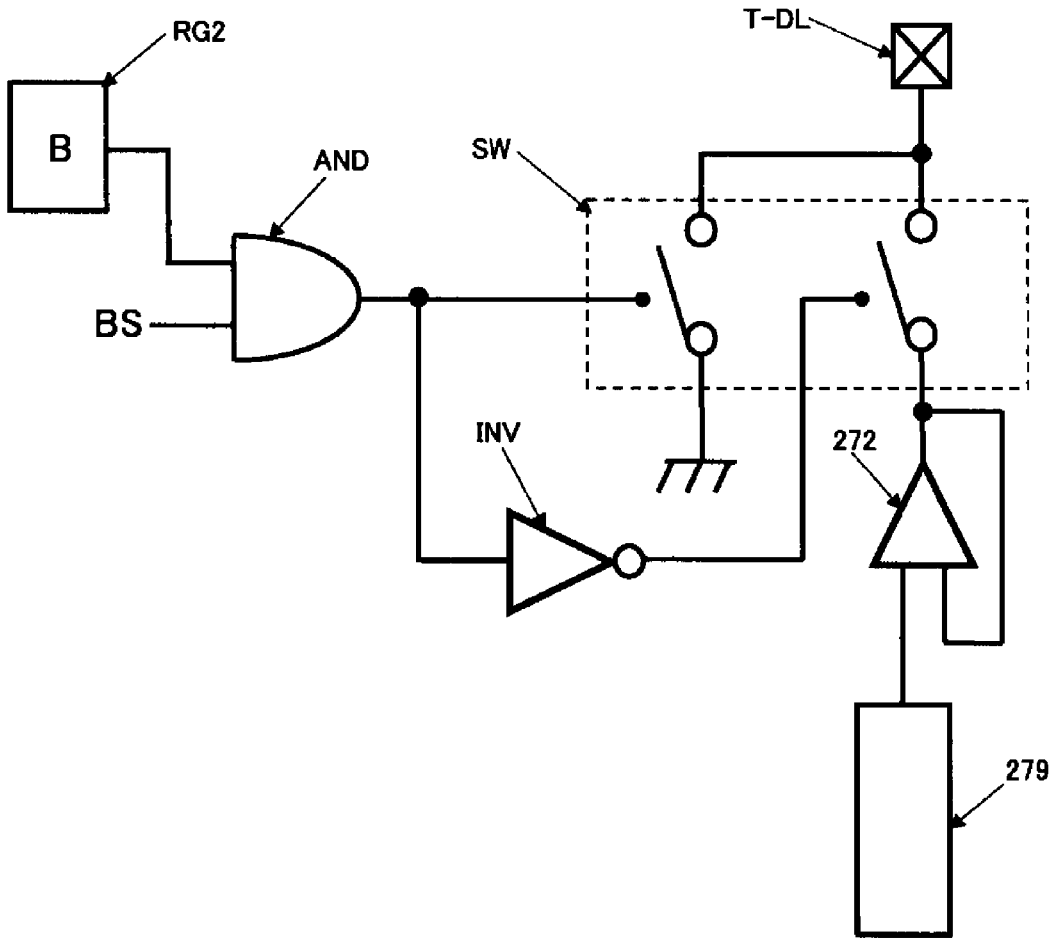
FIG. 10B is a diagram illustrating a circuit configuration of a negative-polarity grayscale voltage generating unit in the drain driver according to the second embodiment.

FIG. 10A shows a diagram illustrating a circuit configuration of a positive-polarity grayscale voltage generating unit in a drain driver according to the second embodiment, and FIG. 10B shows a diagram illustrating a circuit configuration of a negative-polarity grayscale voltage generating unit in the drain driver according to the second embodiment.

In the liquid crystal display device according to this embodiment, a register circuit RG1 or RG2 is provided, and it is configured in such a manner that the output of the amplifier circuit 10 and the voltage of the GND from the terminal portion T-DL can be switched and output at the time of the minimum-level grayscale (0 level) in accordance with a voltage level of data A stored in the register circuit RG1 and a voltage level of data B stored in the register circuit RG2.

That is, in regard to FIG. 10A, in a case where the voltage level of the data A stored in the register circuit RG1 is an H level (state 1), an AND circuit AND outputs an H level when the signal BS is an H level, and outputs an L level when the signal BS is an L level. Therefore, in the case of the state 1, the switch circuit SW outputs an output of the high-voltage amplifier circuit 271 that amplifies an output of the high-voltage decoder circuit 278 to the terminal portion T-DL when the signal BS is the L level, and the switch circuit SW outputs the voltage of the GND to the terminal portion T-DL when the signal BS is the H level.

In addition, in regard to FIG. 10A, in a case that the voltage level of the data A stored in the register circuit RG1 is an L level (state 2), the AND circuit AND always outputs the L level. Therefore, in the case of the state 2, the switch circuit SW outputs the output of the high-voltage amplifier circuit 271 to the terminal portion T-DL regardless of the H level and L level of the signal BS.

Similarly to this, in regard to FIG. 10B, in a case where the voltage level of the data B stored in the register circuit RG2 is the H level (state 3), the AND circuit AND outputs the H level when the signal BS is the H level, and outputs the L level when the signal BS is the L level. Therefore, in the case of the state 3, the switch circuit SW outputs the output of the low-voltage amplifier circuit 272 that amplifies an output of the low-voltage decoder circuit 279 to the terminal portion T-DL when the signal BS is the L level, and the switch circuit SW outputs the voltage of the GND to the terminal portion T-DL when the signal BS is the H level.

In addition, in regard to FIG. 10B, when the voltage level of the data B stored in the register circuit RG2 is the L level (state 4), the AND circuit AND always outputs the L level. Therefore, in the case of the state 4, the switch circuit SW outputs the output of the low-voltage amplifier circuit 272 to the terminal portion T-DL regardless of the H level and L level of the signal BS.

Table 1 shows voltages output from the terminal portion T-DL at the time of the minimum-level grayscale (0 level) with respect to a combination of the voltage level of the data A stored in the register circuit RG1 and the voltage level of the data B stored in the register circuit RG2.

TABLE 1

| A | B | Output regarding FIG. 10A | Output regarding FIG. 10B |
|---|---|---|---|
| 0 | 0 | 0 level (black) | 0 level (black) |
| 0 | 1 | 0 level (black) | GND |
| 1 | 0 | GND | 0 level (black) |
| 1 | 1 | GND | GND |

[Third Embodiment]

Hereinafter, description will be made with respect to a liquid crystal display device according to a third embodiment of the invention, in which difference with the first embodiment will be mainly described.

Figure 11:
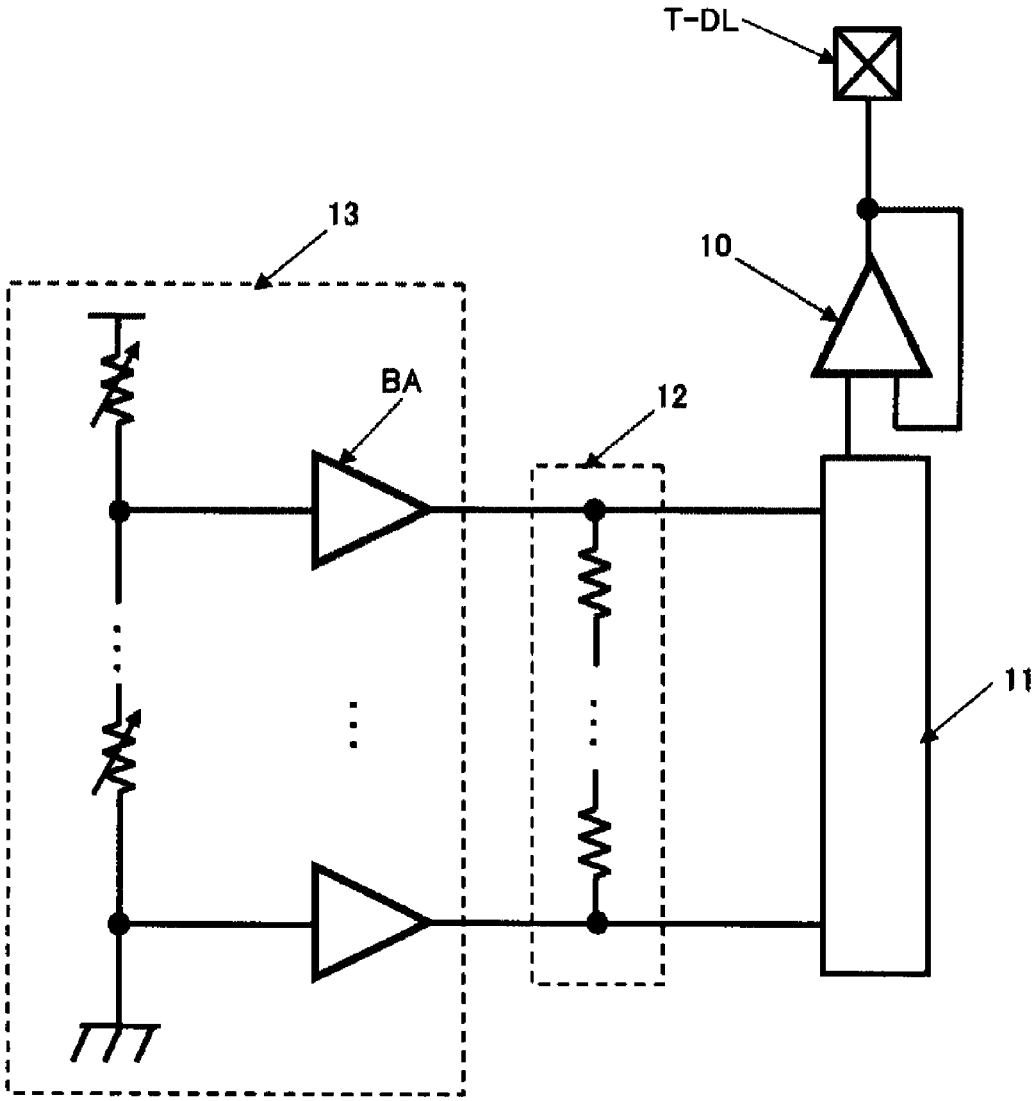
FIG. 11 is a diagram illustrating a circuit configuration of a grayscale voltage generating unit in a drain driver according to a third embodiment.

FIG. 11 shows a diagram illustrating a circuit configuration of a grayscale voltage generating unit in a drain driver according to the third embodiment.

A comparison the circuit in FIG. 6 and the circuit in FIG. 11 indicates that the resistor element RBA shown in FIG. 6 is omitted in FIG. 11. Therefore, in this embodiment, a grayscale reference voltage, which becomes a grayscale voltage of the minimum-level grayscale (0 level), becomes the voltage of the GND.

Therefore, in this embodiment, in the case of displaying the minimum-level grayscale (0 level) on the liquid crystal display panel PNL, it is possible to decrease the grayscale voltage of the minimum-level grayscale (0 level) to substantially 0.05 to 0.1 V, and at the same time, the black brightness is decreased, such that it is possible to improve contrast.

In addition, in the above description, description is made with respect to a case where the driver circuit according to the invention is applied to a liquid crystal display device, but the invention is not limited thereto, and the driver circuit of the invention is applicable to display devices such as an organic EL display device and an inorganic EL display device.

While there have been described what are at present considered to be certain embodiments of the invention, it will be understood that various modifications may be made thereto, and it is intended that the appended claims coverall such modifications as fall within the true spirit and scope of the invention.

What is claimed is:

1. A driver circuit comprising:

an image line driving circuit that supplies a grayscale voltage to a pixel electrode included in a pixel having the pixel electrode and a counter electrode through an image line according to video data input from outside, and a power supply circuit supplying a counter electrode voltage to the counter electrode, wherein when a grayscale voltage of a minimum-level grayscale that is a grayscale that allows a potential difference between the counter electrode and the pixel electrode to be smallest is supplied during an image voltage writing period, a voltage of the pixel electrode is identical to the counter electrode voltage, further comprising a switching element connected to the image line, to a predetermined voltage, which is a constant voltage, and to an output of an amplifying circuit, said switching element being configured to electrically connect the image line to the predetermined voltage in response to a signal which indicates that video data of minimum-level grayscale is input to the switching element from outside when the grayscale voltage of the minimum level grayscale is to be applied to the image line and to electrically connect the image line to the output of the amplifying circuit when a grayscale voltage other than the minimum level grayscale is to be applied to the image line, wherein the predetermined voltage is not the counter electrode voltage, and, in case that the predetermined voltage is supplied to the pixel electrode, a voltage of the pixel electrode is shifted from the predetermined voltage to the counter electrode voltage after passage of an image voltage writing period due to a jumping-in.

2. The driver circuit according to claim 1, wherein the grayscale voltage indicating the minimum-level grayscale is a GND voltage.

3. A driver circuit that supplies a grayscale voltage to a pixel electrode included in a pixel having the pixel electrode and a counter electrode through an image line according to video data input from outside, the driver circuit comprising:

a DA converting circuit that converts the video data input from the outside to a grayscale voltage corresponding to the video data;

an amplifying circuit that amplifies the grayscale voltage output from the DA converting circuit;

a power supply circuit supplying a counter electrode voltage to the counter electrode, and a switch circuit that selects the grayscale voltage output from the amplifying circuit and a predetermined voltage, which is a constant voltage, as a voltage that is output to the image line, wherein when video data having a predetermined level indicating a minimum-level grayscale that is a grayscale which allows a potential difference between the counter electrode and the pixel electrode to be smallest is input to the switch circuit from outside, the switch circuit outputs the predetermined voltage to the image line, and when video data indicating a grayscale other than the minimum-level grayscale is input, the switch circuit outputs the grayscale voltage output from the amplifying circuit to the image line, and wherein the predetermined voltage is not the counter electrode voltage, and, in case that the predetermined voltage is supplied to the pixel electrode, a voltage of the pixel electrode is shifted from the predetermined voltage to the counter electrode voltage after passage of an image voltage writing period due to a jumping-in.

4. The driver circuit according to claim 3, wherein the predetermined voltage is a GND voltage.

5. The driver circuit according to claim 3, further comprising:

a register in which data for controlling the switch circuit is stored, wherein a first state and a second state are selected according to the data stored in the register;

in the first state when video data indicating the grayscale other than the minimum-level grayscale is input, the switch circuit outputs the grayscale voltage output from the amplifying circuit to the image line, and when video data indicating the minimum-level grayscale is input, the switch circuit outputs the predetermined voltage to the image line; and in the second state the switch circuit outputs the grayscale voltage output from the amplifying circuit to the image line regardless of the grayscale.

6. A driver circuit that supplies a grayscale voltage to a pixel electrode included in a pixel having the pixel electrode and a counter electrode through an image line according to video data input from outside, comprising:

a DA converting circuit that converts the video data input from the outside to a grayscale voltage corresponding to the video data;

an amplifying circuit that amplifies the grayscale voltage output from the DA converting circuit;

a power supply circuit supplying a counter electrode voltage to the counter electrode, and a grayscale voltage generating circuit that supplies a plurality of grayscale voltages to the DA converting circuit, wherein the grayscale voltage, which is generated by the grayscale voltage generating circuit, of the minimum-level grayscale is a ground voltage, further comprising a switching element connected to the image line, to the ground voltage and to an output of the amplifying circuit, said switching element being configured to electrically connect the image line to the ground voltage in response to a signal which indicates that video data of minimum-level grayscale is input to the switching element from outside when the minimum level grayscale is to be applied to the image line and to electrically connect the image line to the output of the amplifying circuit when a grayscale voltage other than the minimum level grayscale is to be applied to the image line, a signal is supplied to the switching element when the video data of minimum-level grayscale is input from outside, wherein the ground voltage is not the counter electrode voltage, and, in case that the ground voltage is supplied to the pixel electrode, a voltage of the pixel electrode is shifted from the ground voltage to the counter electrode voltage after passage of an image voltage writing period due to a jumping-in.

7. The driver circuit according to claim 6, wherein the grayscale voltage generating circuit divides a plurality of grayscale reference voltages input from the outside and generates a grayscale voltage of each level, and one of the plurality of grayscale reference voltages is a voltage that is the same as the grayscale voltage of the minimum-level grayscale.

* * * * *